US009515415B1

(12) United States Patent
Lyon

(10) Patent No.: US 9,515,415 B1
(45) Date of Patent: Dec. 6, 2016

(54) STRAIN RELIEF CABLE INSERT

(71) Applicant: TYCO ELECTRONICS CORPROATION, Berwyn, PA (US)

(72) Inventor: Zachary Lyon, Winston Salem, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/812,401

(22) Filed: Jul. 29, 2015

(51) Int. Cl.
*H01R 13/58* (2006.01)

(52) U.S. Cl.
CPC ..... *H01R 13/5812* (2013.01)

(58) Field of Classification Search
CPC ..... H01R 13/5808; H01R 13/58; H01R 13/5816; H01R 13/658; H01R 13/562; H01R 13/5812; H01R 13/5837; H01R 13/5825; H01R 13/502; H01R 13/595; H01R 23/025; H01R 2103/00
USPC ..... 439/455, 460, 453, 469
See application file for complete search history.

(56) References Cited

U.S. PATENT DOCUMENTS 2,396,872 A * 3/1946 Miller ..... H01R 13/625 439/293
2,946,978 A * 7/1960 Cook ..... H01R 13/59 439/460
3,402,382 A * 9/1968 De Tar ..... H01R 13/42 439/469
3,465,092 A * 9/1969 Schwartz ..... H01R 4/646 174/78
3,854,787 A * 12/1974 Snyder, Jr. ..... H01R 13/56 439/447
3,951,505 A * 4/1976 Williams ..... H01R 13/595 439/469
4,053,198 A * 10/1977 Doyle ..... H01R 13/508 439/462
4,166,664 A * 9/1979 Herrmann, Jr. .... H01R 13/6276 439/258
4,211,463 A * 7/1980 Chandler ..... H01R 13/5808 439/468
4,266,844 A * 5/1981 Chelminski ..... H01R 13/523 439/453
4,493,529 A * 1/1985 Doty ..... G02B 6/3816 385/56

(Continued)

*Primary Examiner* — Abdullah Riyami
*Assistant Examiner* — Vladimir Imas

(57) ABSTRACT

A connector assembly includes a connector housing, a cable, and a strain relief insert. The connector housing includes a clamp within an interior chamber. The cable extends into the interior chamber of the connector housing and is compressed by the clamp at a clamping region of the cable to secure the cable to the connector housing. The cable includes plural conductors and an outer jacket surrounding the conductors. Exposed segments of the conductors extend from an end of the outer jacket. The strain relief insert includes a stalk that extends between the conductors into the outer jacket through the end of the outer jacket. The stalk aligns with the clamping region of the cable such that the clamp compresses the conductors into engagement with the stalk.

20 Claims, 5 Drawing Sheets

(56) References Cited

U.S. PATENT DOCUMENTS 4,593,962 A * 6/1986 Knorreck ..... H01R 13/74 439/277
4,952,168 A * 8/1990 Schieferly ..... H01R 13/501 439/467
4,963,104 A * 10/1990 Dickie ..... H01R 9/0524 439/460
5,073,126 A * 12/1991 Kikuchi ..... H01R 4/245 439/397
5,362,258 A * 11/1994 Arnswald ..... H01R 13/521 439/271
5,383,796 A * 1/1995 Bowen ..... H01R 13/595 439/469
5,414,218 A * 5/1995 Nathan ..... H01R 13/5816 174/140 R
5,683,269 A * 11/1997 Davis ..... H01R 13/6593 439/607.5
5,718,607 A * 2/1998 Murphy ..... H01R 9/038 439/579
6,010,348 A * 1/2000 Alden ..... H01R 13/506 439/274
6,077,122 A * 6/2000 Elkhatib ..... H01R 13/5804 439/417
6,099,345 A * 8/2000 Milner ..... H01R 13/6463 174/27
6,135,807 A * 10/2000 Lai ..... H01R 13/6593 439/455
6,162,085 A * 12/2000 Chugh ..... H01R 13/5825 439/275
6,220,888 B1 * 4/2001 Correa ..... H01R 13/562 439/445
6,231,374 B1 * 5/2001 Kuo ..... H01R 13/5816 439/455
6,478,609 B1 * 11/2002 Davis ..... H01R 13/5812 439/465
6,497,589 B1 * 12/2002 Hutchinson ..... H01R 43/20 439/460
6,663,415 B1 * 12/2003 Wu ..... H01R 13/5808 439/460
7,033,193 B2 * 4/2006 Higgins ..... H01R 13/5219 439/277
7,052,282 B2 * 5/2006 Meleck ..... H01R 13/6271 439/163
7,070,417 B2 * 7/2006 Meleck ..... H01R 13/6271 439/163
7,112,086 B1 * 9/2006 Wu ..... H01R 13/5812 439/458
7,201,603 B1 * 4/2007 Finona ..... H01R 13/562 174/86
7,264,494 B2 * 9/2007 Kennedy ..... H01R 13/405 439/274
7,485,806 B1 * 2/2009 Gretz ..... H02G 3/0666 174/135
7,824,108 B2 * 11/2010 Feldner ..... H01R 13/58 385/56
8,002,575 B2 * 8/2011 Li ..... H01R 9/03 439/465
8,083,540 B1 * 12/2011 Spicer ..... H02S 40/34 439/460
8,109,789 B2 * 2/2012 Tyler ..... H01R 13/5205 439/587
8,523,609 B2 * 9/2013 Roman, Jr. ..... H01R 13/5808 439/578
8,672,705 B2 * 3/2014 Schneider ..... G02B 6/3887 439/460
8,735,744 B2 * 5/2014 Schwartz ..... G02B 6/4471 174/652
8,926,363 B2 * 1/2015 Klein ..... H01R 13/533 439/587

* cited by examiner

STRAIN RELIEF CABLE INSERT

BACKGROUND OF THE INVENTION

The subject matter herein relates generally to cable-mount connectors.

Various types of connectors, including electrical connectors and optical connectors, include cables that extend from connector housings. The housing typically covers and protects electrical and/or optical components disposed within the housing, such as printed circuit boards, electrical contacts, optical lenses, optical stubs, or the like. The housing is also configured to provide an interface for mating with a mating connector, such that the electrical and/or optical components within the housing may engage corresponding components of the mating connector. The electrical and/or optical components within the housing terminate to a cable that extends out of the housing to a remote electrical or optical device, such as a computer, a printed circuit board, another connector, or the like.

The cables of many cable-mounted connectors are subject to significant forces on a daily basis including, for example, tension from pulling on the cable to disconnect the connector from a mating connector, impact forces exerted on the outside of the cable, and the like. To reduce the stresses that are applied at terminating locations where conductors of the cable are connected to the corresponding electrical and/or optical components within the housing, many cables are secured to the connector housing using clamps. The clamp typically engages a cable jacket layer that defines an outer perimeter of the cable. Forces on the cable are transmitted through the cable jacket to the housing via the clamp instead of being experienced at the terminating locations between the conductors and the electrical and/or optical components. Furthermore, the conductors surrounded by the cable jacket often have built-in slack along the length of the conductors relative to the cable jacket and/or other layers of the cable such that tension applied on the cable is experienced primarily by the cable jacket instead of by the conductors.

But, although the clamps typically secure the cable jackets in place, the conductors within the jackets are prone to migrate relative to the jackets. For example, during the clamping process and/or over time under normal use conditions, at least some of the conductors may move along a longitudinal cable axis relative to the cable jacket. Such migrating reduces and may eliminate the built-in slack in the conductors. Without the slack, tension and/or other forces applied on the cable may be experienced at the termination locations, which could damage the conductors and/or break the connections between the conductors and the electrical and/or optical components, necessitating repairs and/or replacements.

A need remains for improving the cable strain relief provided by clamps by reducing conductor migration relative to the cable jacket in a simple and efficient way.

BRIEF DESCRIPTION OF THE INVENTION

In one embodiment, a connector assembly is provided that includes a connector housing, a cable, and a strain relief insert. The connector housing extends between a mating end and a cable end. The connector housing defines an interior chamber. The connector housing includes a clamp within the interior chamber. The cable extends into the interior chamber of the connector housing through an aperture at the cable end. The cable is compressed by the clamp to secure the cable to the connector housing. The cable includes a plurality of conductors and an outer jacket that surrounds the conductors along a length of the outer jacket. The clamp engages the outer jacket at a clamping region of the cable that is proximate to an end of the outer jacket. Exposed segments of the conductors extend from a core defined by the outer jacket through an opening at the end of the outer jacket. The strain relief insert includes a stalk that extends between the conductors into the core through the opening at the end of the outer jacket. The stalk aligns with the clamping region of the cable such that the clamp compresses the conductors into engagement with the stalk.

In another embodiment, a cable sub-assembly configured to be secured to a connector housing of a connector is provided. The cable sub-assembly includes a cable and a strain relief insert. The cable includes a plurality of conductors and an outer jacket that surrounds the conductors along a length of the outer jacket. The cable is configured to be compressed by a clamp of the connector housing to secure the cable to the connector housing. Exposed segments of the conductors extend from a core defined by the outer jacket through an opening at an end of the outer jacket. The strain relief insert includes a base and a stalk that extends from the base. The stalk extends between the conductors into the core of the outer jacket through the opening at the end of the outer jacket. The base is disposed outside of the core. The stalk defines at least one bulb along the length of the stalk. The at least one bulb has a larger diameter than a respective narrow segment of the stalk adjacent to the respective at least one bulb. The stalk of the strain relief insert aligns with a clamping region of the cable that is configured to engage the clamp of the connector housing. The conductors are configured to engage the stalk of the strain relief insert and at least partially deform around the at least one bulb thereof when the cable is compressed by the clamp.

DETAILED DESCRIPTION OF THE INVENTION

Figure 1:
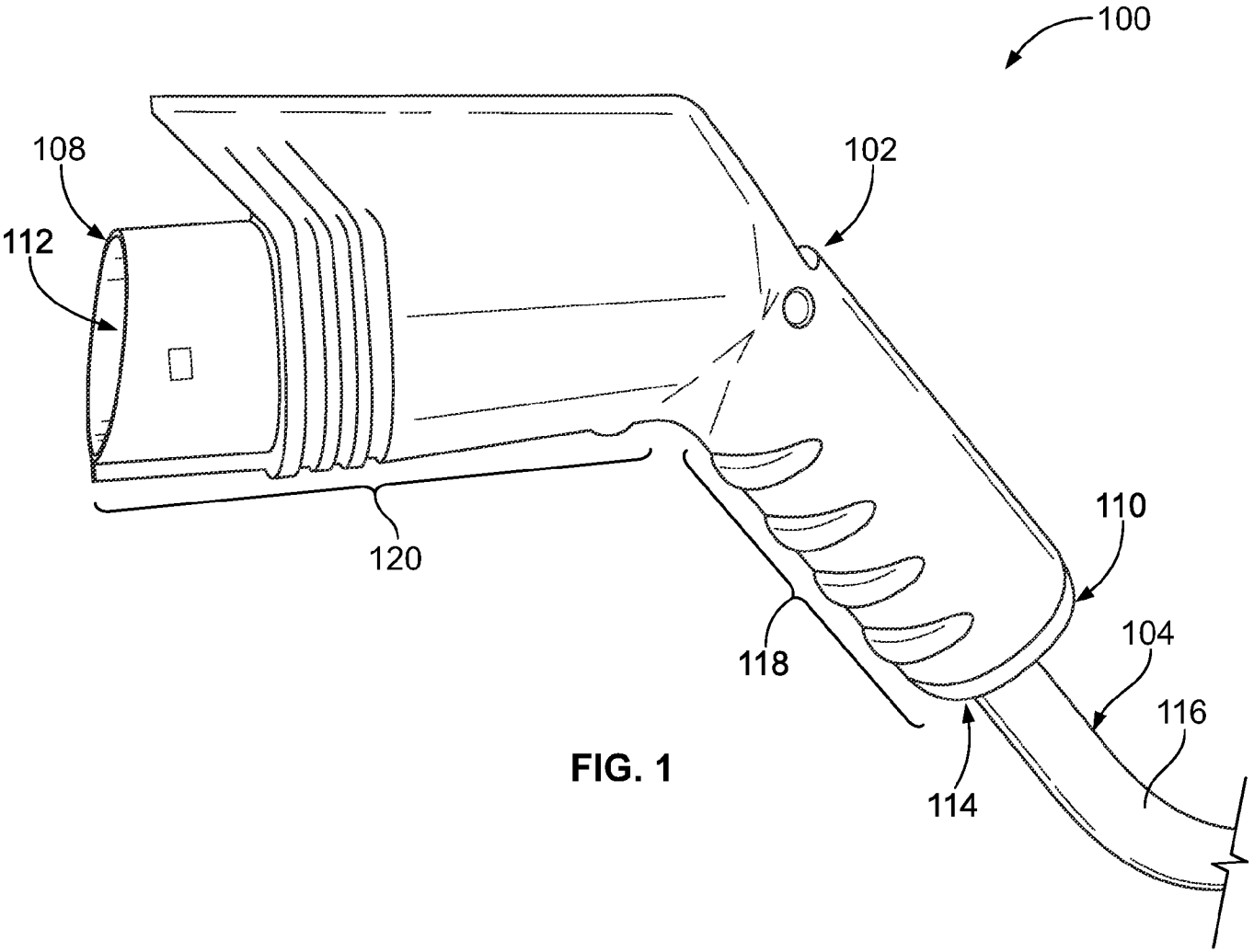
FIG. 1 is a perspective view of a connector assembly in accordance with an embodiment.

FIG. 1 is a perspective view of a connector assembly 100 in accordance with an embodiment. The connector assembly 100 is configured to mate with a mating connector (not shown) to provide a signal path between the connector assembly 100 and the mating connector. The connector assembly 100 may be a plug that is configured to be received into a receptacle of the mating connector, or, alternatively, the connector assembly 100 may define a receptacle that is configured to receive a plug portion of the mating connector. The connector assembly 100 may convey electrical signals (such as data and/or power) and/or optical signals (such as visible and/or infrared light) to and from the mating connector.

The connector assembly 100 includes a connector housing 102 and a cable 104 that is secured to the housing 102. The cable 104 includes conductors 146 (shown in FIG. 2) that terminate within the housing 102 to an electrical and/or optical component (not shown). In one or more embodiments described herein, the cable 104 is an electrical cable such that the conductors 146 convey electrical signals therethrough to an electrical component within the housing 102. The electrical component may be a printed circuit board, electrical contacts, or the like. In an alternative embodiment, the cable 104 is an optical cable instead of, or in addition to being an electrical cable, such that the conductors convey optical signals to and from an optical component within the housing 102. The optical component may be or include a lens, an optical light guide, an optical stub, or the like.

The connector housing 102 extends between a mating end 108 and a cable end 110. The mating end 108 interfaces with a mating connector. The housing 102 defines an interior chamber 112 that extends through the housing 102 between the mating end 108 and the cable end 110. The electrical and/or optical component is held within the interior chamber 112. The cable 104 extends into the interior chamber 112 through an aperture 114 at the cable end 110. An exterior portion 116 of the cable 104 is disposed outside of the connector housing 102 and extends remotely from the housing 102 to a remote device, such as a computer, another connector, or the like.

In the illustrated embodiment, the connector housing 102 is not linear between the mating end 108 and the cable end 110. For example, the housing 102 has a cable securing region 118 and a mating region 120. The cable securing region 118 extends generally from the cable end 110 to the mating region 120, and the mating region 120 extends generally from the mating end 108 to the cable securing region 118. The cable securing region 118 is oriented transverse to the mating region 120 in the illustrated embodiment, such that an axis defined longitudinally through the cable securing region 118 would intersect an axis defined longitudinally through the mating region 120 at an angle other than a right angle. In alternative embodiments, however, the cable securing region 118 may be perpendicular to the mating region 120 or the cable securing region 118 may extend parallel to or in-line with the mating region 120.

The connector housing 102 may have a shape that corresponds to a particular application of the connector assembly 100. In the illustrated embodiment, the connector assembly 100 is an electrical power charger for an electric vehicle. The mating region 120 is sized and shaped as a mating interface to be plugged into a receptacle located on an electric vehicle. The cable 104 may be used to convey electrical power (for example, current and voltage). The cable securing region 118 is sized and shaped as a handle for connecting and disconnecting the connector housing 102 relative to the receptacle on the electric vehicle. An electric vehicle charger is merely one example embodiment, and the housing 102 may be shaped for other electrical and optical applications in other embodiments. For example, the connector assembly 100 may be used to provide data signals and/or control signals to and from the electric vehicle or another device in an alternative embodiment.

Figure 2:
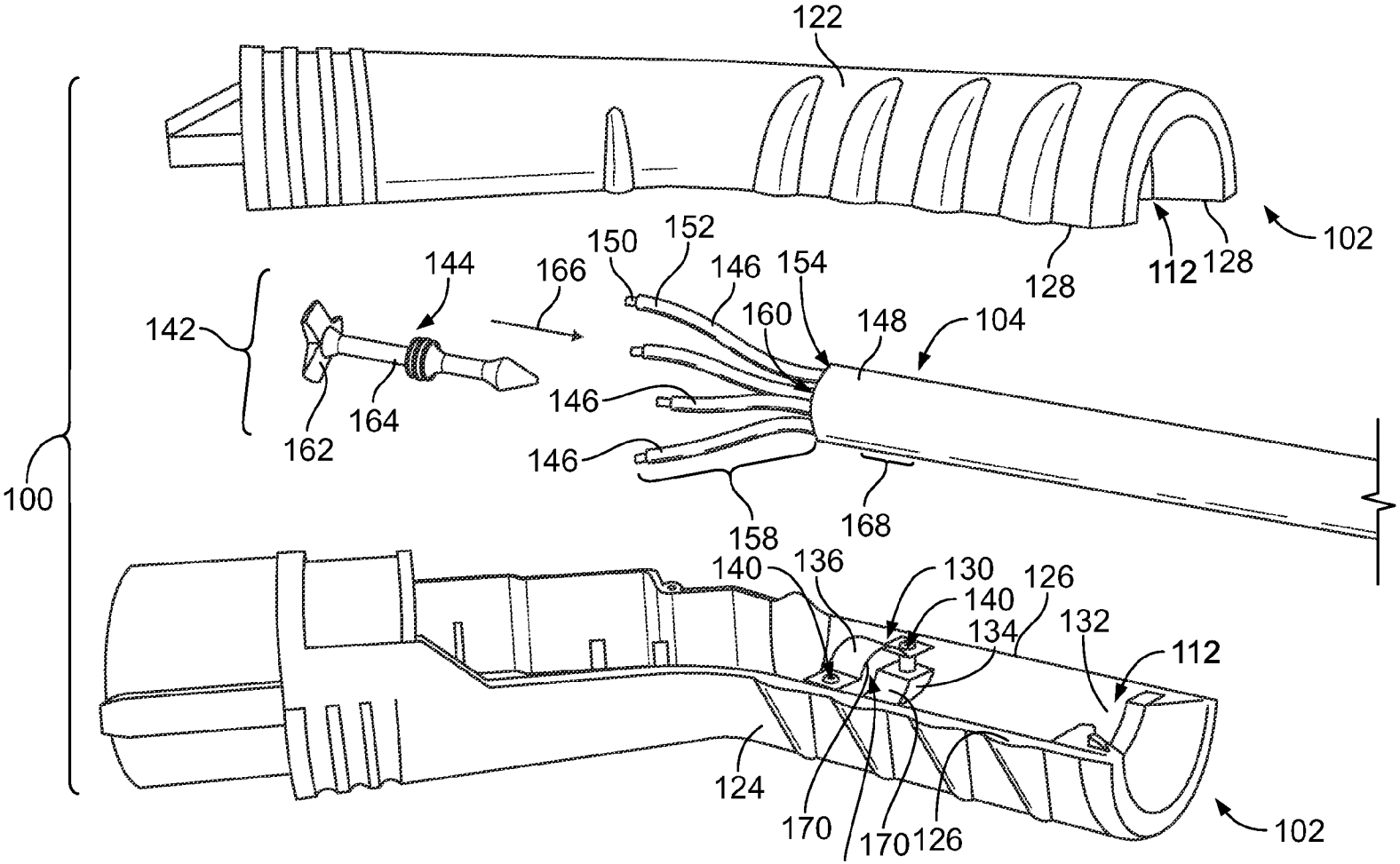
FIG. 2 is an exploded perspective view of the connector assembly according to an embodiment.

FIG. 2 is an exploded perspective view of the connector assembly 100 according to an embodiment. The connector housing 102 is defined by an upper shell 122 and a lower shell 124 that couple together. As used herein, relative or spatial terms such as "upper," "lower," "left," "right," "first," and "second" are only used to distinguish the referenced elements and do not necessarily require particular positions or orientations in the connector assembly 100 or in the surrounding environment of the connector assembly 100. The upper and lower shells 122, 124 include curved walls that define respective portions of the interior chamber 112 when the shells 122, 124 are coupled together. The upper and lower shells 122, 124 are coupled by joining side edges 126 of the upper shell 122 with respective side edges 128 of the lower shell 124 at an interface. The shells 122, 124 may be joined via a welding process, adhesives, mechanical fasteners, and/or the like. The shells 122, 124 may be composed of a dielectric material, such as one or more plastics or other polymers.

Prior to coupling the upper and lower shells 122, 124, the cable 104 is secured within the housing 102 using a clamp 130. The clamp 130 is disposed within the interior chamber 112. In the illustrated embodiment, the clamp 130 is mounted to an interior wall 132 of the lower shell 124. The clamp 130 is configured to engage and compress the cable 104 to secure the cable 104 to the housing 102. In the illustrated embodiment, the clamp 130 includes a base member 134 and a cover member 136. The base member 134 is secured to the interior wall 132. Optionally, the base member 134 is integral to the lower shell 124 such that the base member 134 is formed along the interior wall 132 as the lower shell 124 is being formed. The cover member 136 and the base member 134 are curved in opposite directions and define a channel 138 therebetween that receives the cable 104 therethrough. The cover member 136 is coupled to the base member 134 via fasteners 140 disposed outside of the channel 138. The fasteners 140 may be screws, bolts, or the like. The diameter of the channel 138 is adjusted by actuating the fasteners 140 to move the cover member 136 relative to the base member 134. For example, tightening the fasteners 140 may reduce the distance between the cover member 136 and the base member 134, which reduces the diameter of the channel 138. Thus, after inserting the cable 104 through the channel 138, the clamp 130 may be tightened by rotating or otherwise actuating the fasteners 140 such that the diameter of the channel 138 decreases and the clamp 130 compresses the cable 104. The clamp 130 may have other shapes and components in other embodiments. For example, the clamp 130 in one alternative embodiment may be formed by one or more clamp ribs (not shown) integral to the upper shell 122 and one or more clamp ribs integral to the lower shell 124, where the clamp ribs engage and compress the cable 104 as the shells 122, 124 are coupled together.

The connector assembly 100 includes a cable sub-assembly 142 featuring the cable 104 and a strain relief insert 144 that is configured to be loaded into the cable 104. In the illustrated embodiment, the cable 104 is an electrical cable that includes a plurality of electrical conductors 146 bundled together within an outer jacket 148. Each of the conductors 146 includes an electrically-conductive core member 150 that is solid or stranded, and an insulation layer 152 surrounding the core member 150. Although four conductors 146 are shown in FIG. 2, the cable 104 may include less than four or more than four conductors 146 in other embodiments. The outer jacket 148 extends around a perimeter of the conductors 146 and commonly surrounds the conductors 146. The outer jacket 148 is configured to protect and insulate the conductors 146 from external influences, such as impact forces, electromagnetic radiation, dirt and other debris, heat, moisture, and the like.

The outer jacket 148 surrounds the conductors 146 along the length of the outer jacket 148. For example, the outer jacket 148 extends to an end 154. The conductors 146 are held within a core 210 (shown in FIG. 6) defined by the outer jacket 148. As used herein, the core 210 is the space within the outer jacket 148. Exposed segments 158 of the conductors 146 extend from the core 210 of the outer jacket 148 through an opening 160 at the end 154 of the jacket 148. The exposed segments 158 are not surrounded by the outer jacket 148. The exposed segments 158 are configured to be terminated to corresponding electrical contacts (not shown) or conductive elements of a printed circuit board (not shown) within the interior chamber 112 of the housing 102.

The strain relief insert 144 includes a base 162 and a stalk 164 that extends from the base 162. The strain relief insert 144 is loaded in a loading direction 166 into the core 210 (shown in FIG. 6) of the outer jacket 148 through the opening 160 at the end 154 of the jacket 148. For example, the strain relief insert 144 is oriented such that the stalk 164 engages and extends between the conductors 146 as the strain relief insert 144 is moved into the core 210. The base 162 is configured to not be received within the core 210 such that only the stalk 164 enters the core 210. For example, the base 162 has a large diameter that does not fit within the core 210. The base 162 provides a hard stop surface that engages the conductors 146 and/or the end 154 of the outer jacket 148 to prevent further movement of the strain relief insert 144 in the loading direction 166. The hard stop provided by the base 162 serves to align the strain relief insert 144 relative to the cable 104. As discussed in more detail herein, the stalk 164 has an undulating profile along a length of the stalk 164. For example, the diameter of the stalk 164 varies along the length of the stalk 164 due to one or more large diameter segments and one or more narrow diameter segments.

To assemble the connector assembly 100, the strain relief insert 144 is loaded into the cable 104, forming the cable sub-assembly 142. The strain relief insert 144 is held in place due to a friction fit between the conductors 146. The cable sub-assembly 142 is inserted into and/or through the clamp 130 mounted to the lower shell 124. The clamp 130 aligns with a clamping region 168 of the cable 104 that is proximate to the end 154 of the outer jacket 148. In an embodiment, the clamping region 168 identifies the portion of the cable 104 that engages the clamp 130. The clamp 130 is subsequently tightened such that a curved interior surface 170 of the clamp 130 engages the outer jacket 148 at the clamping region 168. The clamp 130 compresses the cable 104 radially inwards to secure the cable 104 to the lower shell 124. After clamping the cable 104 to the lower shell 124 (and loading any additional electrical components into the lower shell 124 and/or the upper shell 122), the upper and lower shells 122, 124 are coupled to one another to form the connector housing 102.

The stalk 164 of the strain relief insert 144 within the cable 104 aligns with the clamping region 168. As the cable 104 is compressed by the clamp 130, the conductors 146 are forced into engagement with the stalk 164. Under the high compressive forces, the conductors 146 may at least partially deform around the undulating profile of the stalk 164. For example, the insulation layers 152 of the conductors 146 are formed of a dielectric material, such as a plastic, that is at least partially deformable under high compressive forces. The stalk 164 of the strain relief insert 144 is formed of a harder material than the insulation layers 152, such that the conductors 146 deform more readily than the strain relief insert 144. The undulating profile of the stalk 164 increases the surface area that the conductors 146 engage the stalk 164 relative to a uniform profile of the stalk 164. As a result, the strain relief insert 144 secures the axial location of the conductors 146 relative to the outer jacket 148 and the lower shell 124, preventing, or at least significantly reducing, migration of the conductors 146. Therefore, the strain relief insert 144 improves performance of the connector assembly 100 by reducing tension experienced by the conductors 146 of the cable 104, which typically occurs after the conductors 146 migrate relative to the outer jacket 148, eliminating the built-in slack of the conductors 146.

Figure 3:
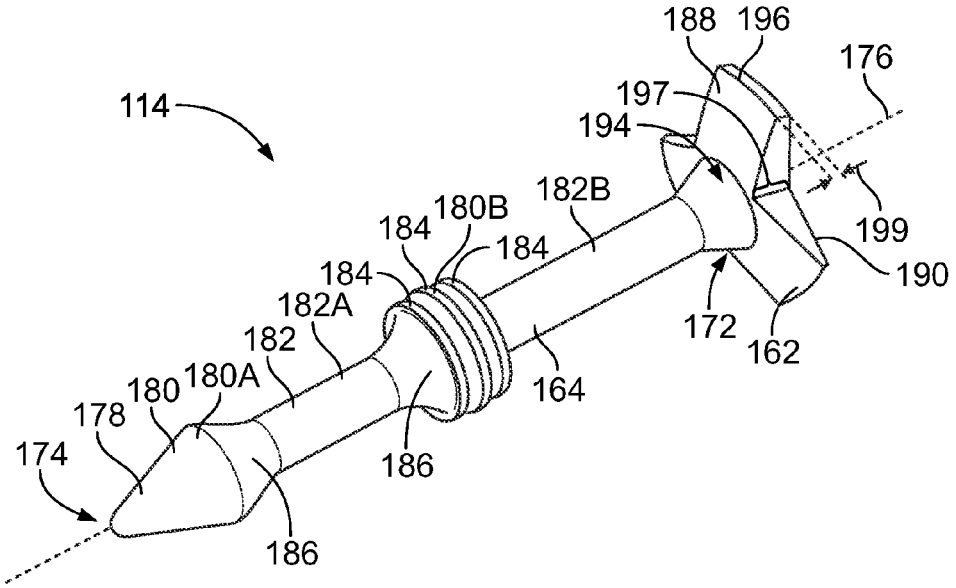
FIG. 3 is a front perspective view of a strain relief insert of the connector assembly according to an embodiment.

FIG. 3 is a front perspective view of the strain relief insert 144 according to an embodiment. The stalk 164 extends along a longitudinal axis 176 from a rear end 172 at the base 162 to an opposite front end 174. The front end 174 of the stalk 164 is tapered to define a lead-in segment 178. The tapered lead-in 178 is configured to guide the stalk 164 into the core 210 (shown in FIG. 6) of the outer jacket 148 (shown in FIG. 2) between the conductors 146 (FIG. 2) as the strain relief insert 144 is loaded into the cable 104 (FIG. 2). For example, the tapered lead-in 178 provides a wedge that gradually displaces the conductors 146 that the stalk 164 engages to allow the stalk 164 to penetrate small interstices between the conductors 146.

The stalk 164 defines at least one bulb 180 along the length of the stalk 164. Each bulb 180 is adjacent to at least one narrow segment 182 of the stalk 164. Each bulb 180 has a larger diameter than a respective adjacent narrow segment 182. For example, the one or more bulbs 180 are curved protrusions that extend radially outward from the stalk 164. The one or more bulbs 180 and narrow segments 182 provide the stalk 164 with an undulating profile along the longitudinal axis 176. In the illustrated embodiment, the stalk 164 includes two bulbs 180. A front bulb 180A is located at, or proximate to, the front end 174, and a medial bulb 180B is located between the front bulb 180A and the base 162. The lead-in segment 178 at the front end 174 of the stalk 164 may extend from the front bulb 180A, as shown, or alternatively may be spaced apart from the front bulb 180A. The front bulb 180A is spaced apart from the medial bulb 180B by a first narrow segment 182A. The medial bulb 180B is spaced apart from the base 162 by a second narrow segment 182B. The diameters of the narrow segments 182A, 182B are less than the diameters of the front and medial bulbs 180A, 180B. The first narrow segment 182A may have the same diameter or a different diameter than the second narrow segment 182B, and may have the same length along the longitudinal axis 176 or a different length than the second narrow segment 182B. The front bulb 180A may have the same diameter or a different diameter than the medial bulb 180B. Although two bulbs 180 are shown in FIG. 3, in other embodiments, the stalk 164 may include only one bulb 180 or more than two bulbs 180 spaced apart along the length.

In an embodiment, at least one bulb 180 includes multiple annular ribs 184. The annular ribs 184 protrude from the surface 186 of the respective bulb 180 and extend around a perimeter of the bulb 180. In the illustrated embodiment, the medial bulb 180B includes three annular ribs 184, and the front bulb 180A lacks annular ribs, such that the surface 186 of the front bulb 180A is generally smooth. The annular ribs 184 of the medial bulb 180B are oriented parallel to one another. The annular ribs 184 may be oriented perpendicular to the longitudinal axis 176 of the stalk 164. The annular ribs 184 increase the contact surface area between the medial bulb 180B and the conductors 146 (shown in FIG. 2), which may increase the friction and grip on the conductors 146. In an alternative embodiment, the front bulb 180A may include annular ribs 184 in addition to, or instead of, the medial bulb 180B.

The base 162 includes a first side 188 and a second side 190. The stalk 164 extends from the first side 188. In the illustrated embodiment, the stalk 164 extends from the base 162 at an approximate radial center location 194 of the base 162, such that the stalk 164 is centered relative to the base 162. Optionally, the first side 188 slopes towards the radial center location 194 from an outer edge 196 of the base 162. For example, a thickness of the base 162 between the first and second sides 188, 190 varies radially. A first thickness 197 of the base 162 at the radial center location 194 is greater than a second thickness 199 of the base 162 at the outer edge 196.

Figure 4:
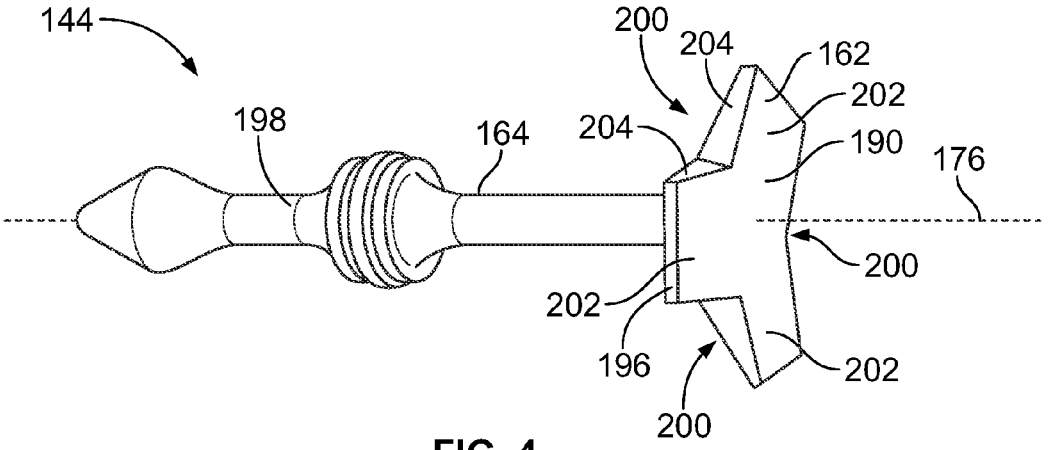
FIG. 4 is a rear perspective view of the embodiment of the strain relief insert shown in FIG. 3.

FIG. 4 is a rear perspective view of the embodiment of the strain relief insert 144 that is shown in FIG. 3. The second side 190 of the base 162 in an embodiment is planar. The plane of the second side 190 may be perpendicular to the longitudinal axis 176 of the stalk 164. The planar second side 190 may provide a pressing surface for pressing the strain relief insert 144, manually or with a tool or device, into the cable 104 (shown in FIG. 2) between the conductors 146 (FIG. 2).

The base 162 defines multiple indentations 200 around a perimeter of the base 162. For example, the indentations 200 extend radially inward from the outer edge 196 of the base 162. The indentations 200 are angularly spaced apart from one another around the perimeter. The indentations 200 are separated from one another by intervening tabs 202. Each indentation 200 is defined between two side edges 204 of adjacent tabs 202. The indentations 200 provide a path for the conductors 146 (shown in FIG. 1) to extend through the base 162 without bending all of the way around the outer edges 196 of the tabs 202, as shown and described in FIG. 5. The tabs 202 separate the conductors 146. The base 162 includes three indentations 200 and three tabs 202 in the illustrated embodiment, but the base 162 may have other numbers and/or shapes of indentations and/or tabs in other embodiments.

In an embodiment, the strain relief insert 144 is composed of a dielectric material, such as one or more plastics or other polymers. For example, the strain relief insert 144 may be formed of nylon, polyvinyl chloride, or another synthetic polymer. The dielectric material may be selected such that the strain relief insert 144 is sufficiently hard, strong, and/or pressure and heat resistant to reduce or avoid deformation of the strain relief insert 144 during the clamping process to secure the cable 104 (shown in FIG. 2) to the connector housing 102 (FIG. 2). The dielectric material of the strain relief insert 144 may also be harder, stronger, and/or more heat and/or pressure resistant than the dielectric material of the insulation layers 152 (shown in FIG. 2) of the conductors 146, such that the insulation layers 152 form around the undulating profile of the stalk 164 when compressed, instead of the stalk 164 forming around the conductors 146. In an exemplary embodiment, the strain relief insert 144 is a single, discrete component having a unitary body 198. Thus, the stalk 164 is integral to the base 162. For example, the stalk 164 is formed concurrently with the base 162 instead of forming the stalk 164 and the base 162 separately and then subsequently joining the stalk 164 to the base 162. The strain relief insert 144 may be formed through a molding process. In an alternative embodiment, the strain relief insert 144 is formed of a conductive material, such as one or more metals.

Figure 5:
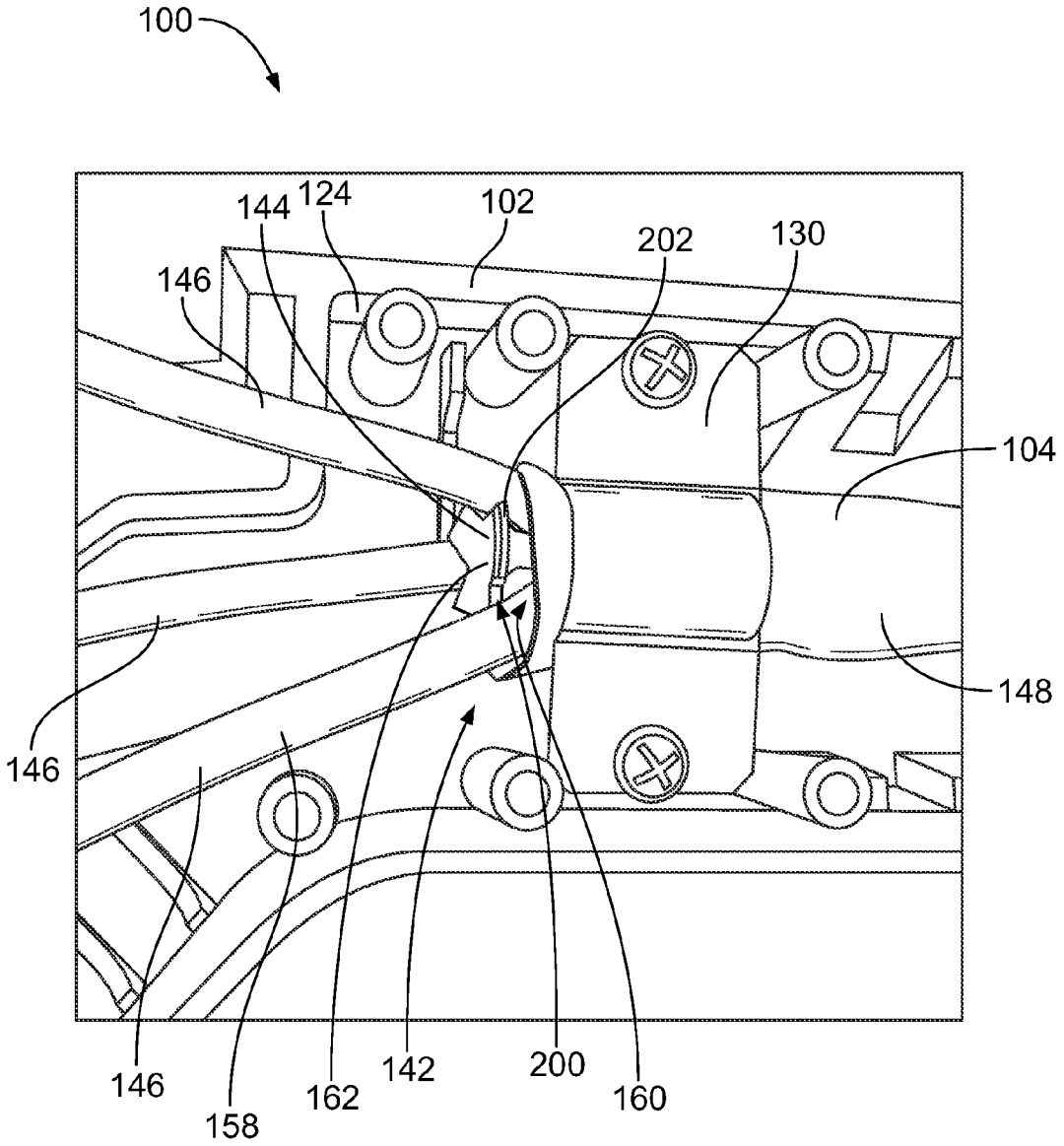
FIG. 5 is a top view of a portion of the connector assembly according to an embodiment with an upper shell of a connector housing removed.

FIG. 5 is a top view of a portion of the connector assembly 100 according to an embodiment with the upper shell 122 (shown in FIG. 2) of the connector housing 102 removed. In FIG. 5, the cable sub-assembly 142 is secured to the lower shell 124 via the clamp 130. The strain relief insert 144 is loaded within the cable 104 between the conductors 146. The base 162 of the strain relief insert 144 is external of the core 210 (shown in FIG. 6) defined by the outer jacket 148. The base 162 has a larger diameter than the opening 160 of the outer jacket 148, so the first side 188 (shown in FIG. 3) that faces the opening 160 provides a hard stop surface to prevent the strain relief insert 144 from being loaded too far into the cable 104. For example, the hard stop surface of the base 162 allows the stalk 164 (shown in FIG. 3) to align properly with the clamping region 168 (shown in FIG. 2) of the cable 104 (and, transitively, to align properly with the clamp 130). As shown in FIG. 5, the exposed segments 158 of the conductors 146 are received in the indentations 200 of the base 162 to extend beyond the base 162 without extending around the tabs 202.

Figure 6:
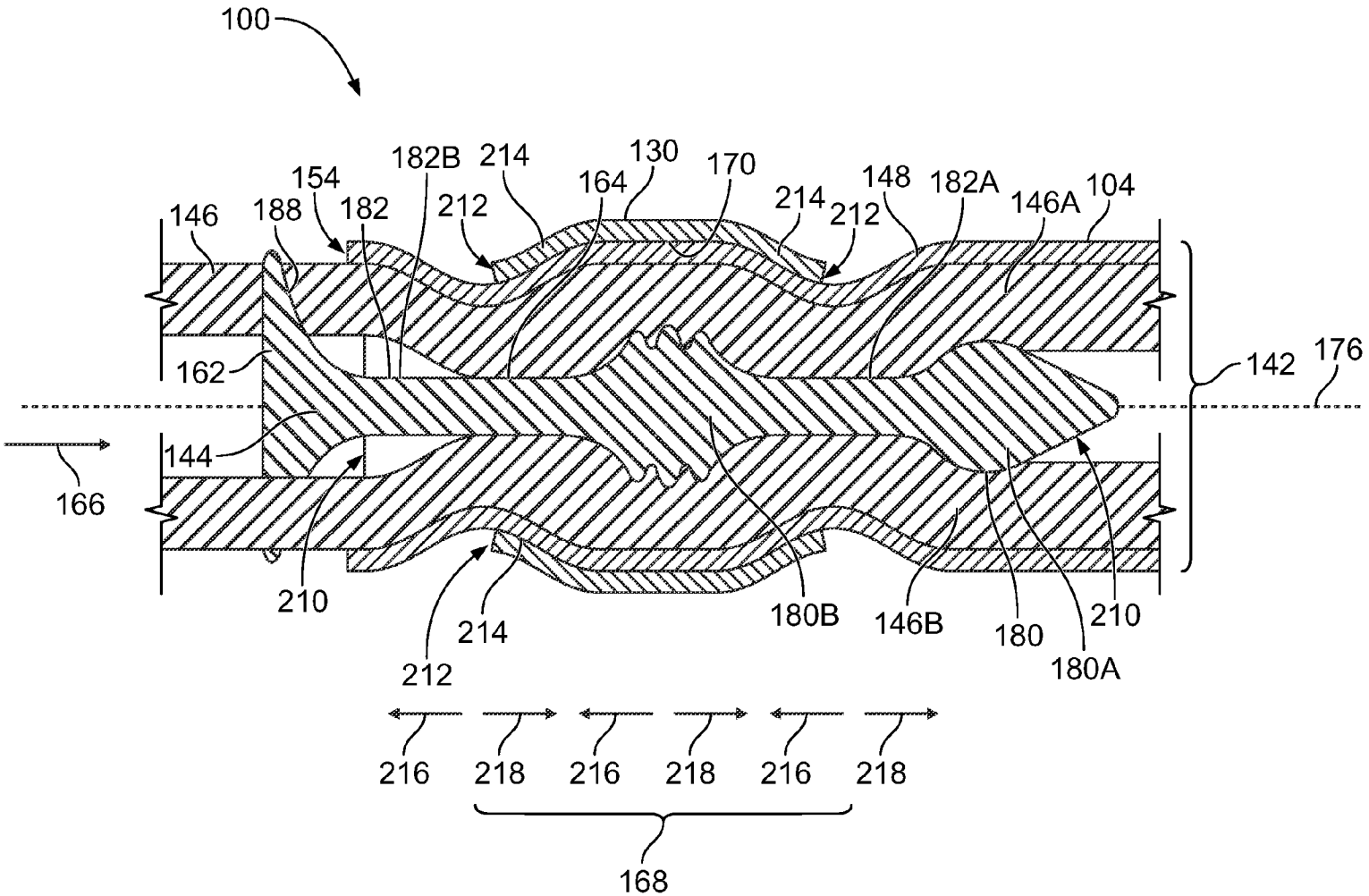
FIG. 6 is a cross-sectional view of the connector assembly according to an embodiment.

FIG. 6 is a cross-sectional view of a portion of the connector assembly 100 according to an embodiment. FIG. 6 shows the cable sub-assembly 142 compressed by the clamp 130. The stalk 164 of the strain relief insert 144 extends within the core 210 of the outer jacket 148 between the conductors 146. The conductors 146 are positioned radially outward of the stalk 164 of the strain relief insert 144, such as between the stalk 164 and the outer jacket 148. In the illustrated cross-section, one visible conductor 146A extends above the stalk 164, and a second visible conductor 146B extends below the stalk 164. The conductors 146 may be at other angular orientations about the stalk 164. Optionally, the conductors 146 may be wrapped at least partially helically around the stalk 164.

The strain relief insert 144 is configured to align with the clamping region 168 of the cable 104 in order to align with the clamp 130. For example, when the first side 188 of the base 162 abuts against the conductors 146 and/or the end 154 of the outer jacket 148 to provide a hard stop to block further movement in the loading direction 166, at least one of the bulbs 180 of the stalk 164 aligns axially (along the longitudinal axis 176) with the clamping region 168 of the cable 104. Therefore, when the clamp 130 compresses the cable 104 at the clamping region 168, the conductors 146 are forced into engagement with the respective bulb(s) 180 within the clamping region 168. Optionally, the pressure exerted on the cable 104 by the clamp 130 may be sufficient to at least partially deform and mold the conductors 146 around the respective bulb(s) 180 within the clamping region 168. For example, dielectric material of the conductors 146 that aligns axially with a respective bulb 180 may be sandwiched between the bulb 180 and the outer jacket 148 at sufficient pressure to force the material to compress and/or flow axially away from the bulb 180 towards an adjacent narrow segment 182 of the stalk 164. In the illustrated embodiment, the medial bulb 180B aligns axially within the clamping region 168, such that the medial bulb 180B is between two ends 212 of the clamp 130. The front bulb 180A extends into the core 210 beyond the clamping region 168.

In an embodiment, the clamp 130 includes at least two projections 214 that extend radially inward from the interior surface 170 of the clamp 130. The projections 214 in the illustrated embodiment are disposed at the respective ends 212 of the clamp 130, but the number and positions of projections 214 may be different in other embodiments. The stalk 164 of the strain relief insert 144 is positioned within the core 210 relative to the clamp 130 such that each of the projections 214 aligns axially with a corresponding narrow segment 182 of the stalk 164. For example, the projections 214 align axially with the first and second narrow segments 182A, 182B that border the medial bulb 180B. The ends 212 of the clamp 130 may be tapered or bent radially inwards to define the projections 214. Alternatively, the projections 214 may extend inward from a planar interior surface 170 of the clamp 130 such that the cross-sectional thickness of the clamp 130 is greater at the projections 214 than along adjacent sections of the clamp 130. The projections 214 may dig into the outer jacket 148.

When the clamp 130 compresses the clamping region 168 of the cable 104, the conductors 146 are compressed into engagement with the undulating profile of the stalk 164, such as along the bulbs 180A, 180B and the intervening narrow segments 182A, 182B. The undulating profile of the stalk 164 and the projections 214 of the clamp 130 force the conductors 146 to follow an undulating longitudinal profile that aligns with the undulating profile of the stalk 164. The conductors 146 may follow a tortuous path along the strain relief insert 144. Areas of higher pressure, such as areas that align with the projections 214 and the medial bulb 180B, may cause some of the dielectric material of the conductors 146 to flow, slide, stretch, or otherwise move axially to regions of reduced pressure. For example, the dielectric material that aligns with the medial bulb 180B, when compressed, may flow in a first direction 216 along the longitudinal axis 176 towards the end 154 of the outer jacket 148, and other material may flow in an opposite second direction 218 along the longitudinal axis 176. The dielectric material may bunch in areas of reduced pressure between higher pressure areas, and such bunching may increase the contact surface area and friction in the reduced pressure areas. In general, the strain relief insert 144 increases friction between the conductors 146 and the outer jacket 148 to reduce (or potentially eliminate) the tendency or ability of the conductors 146 to migrate relative to the outer jacket 148 in use after clamping the cable 104 to the connector housing 102 (shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector assembly comprising:

a connector housing extending between a mating end and a cable end, the connector housing defining an interior chamber, the connector housing including a clamp within the interior chamber;

a cable extending into the interior chamber of the connector housing through an aperture at the cable end, the cable being compressed by the clamp to secure the cable to the connector housing, the cable including a plurality of conductors and an outer jacket that surrounds the conductors along a length of the outer jacket, the clamp engaging the outer jacket at a clamping region of the cable that is proximate to an end of the outer jacket, the conductors including exposed segments that protrude from an opening at the end of the outer jacket; and a strain relief insert including a stalk, the stalk extending between the conductors into the opening at the end of the outer jacket, the stalk defining a bulb along a length of the stalk, the bulb having a larger diameter than a narrow segment of the stalk adjacent to the bulb, the bulb of the stalk aligning with the clamping region of the cable such that the clamp compresses the conductors into engagement with bulb.

2. The connector assembly of claim 1, wherein the clamp includes two projections extending radially inward from an interior surface of the clamp, the strain relief insert positioned relative to the clamp such that bulb of the stalk aligns axially between the projections of the clamp.

3. The connector assembly of claim 1, wherein the stalk extends from a rear end to an opposite front end, the front end of the stalk having a tapered lead-in configured to guide the stalk into the outer jacket between the conductors as the strain relief insert is loaded into the outer jacket.

4. The connector assembly of claim 1, wherein the stalk extends from a rear end to an opposite front end, the rear end being joined to a base of the strain relief insert, the bulb defining a front bulb at least one of at or proximate to the front end, the stalk further including a medial bulb between the front bulb and the base, the front bulb and the medial bulb each having a larger diameter than the narrow segment of the stalk between the front and medial bulbs.

5. The connector assembly of claim 1, wherein the bulb includes at least one annular rib that protrudes from a surface of the bulb and extends around a perimeter of the bulb.

6. The connector assembly of claim 1, wherein the strain relief insert further includes a base joined to the stalk, the base being disposed outside of the outer jacket, the base including a first side and a second side, the stalk extending from the first side of the base, the second side defining a pressing surface for pressing the strain relief insert into the outer jacket.

7. The connector assembly of claim 1, wherein the strain relief insert further includes a base joined to the stalk, the base including a first side and a second side, the stalk extending from the first side at an approximate radial center location of the base, the first side sloping towards the radial center location from an outer edge of the base such that a thickness of the base defined between the first and second sides is greater at the radial center location than at the outer edge.

8. The connector assembly of claim 1, wherein the strain relief insert further includes a base joined to the stalk, the base defining multiple indentations extending radially inward from a perimeter of the base, the indentations being spaced apart from one another around the perimeter by intervening tabs, the base receiving the conductors of the cable in the indentations between the tabs, the tabs separating the conductors.

9. The connector assembly of claim 1, wherein the strain relief insert is composed of a dielectric material.

10. The connector assembly of claim 1, wherein the strain relief insert further includes a base joined to the stalk, the strain relief insert having a unitary body such that the stalk is integral to the base.

11. The connector assembly of claim 1, wherein the conductors are electrical conductors that each includes a dielectric insulation layer surrounding an electrically conductive core member, the insulation layers of the conductors configured to engage the stalk of the strain relief insert and deform around the bulb when the clamp compresses the cable.

12. A cable sub-assembly configured to be secured to a connector housing of a connector, the cable sub-assembly comprising:

a cable including a plurality of conductors and an outer jacket that surrounds the conductors along a length of the outer jacket, the cable configured to be compressed by a clamp of the connector housing at a clamping region of the cable to secure the cable to the connector housing, the conductors including exposed segments that protrude from an opening at an end of the outer jacket; and a strain relief insert including a base and a stalk that extends from the base, the stalk extending between the conductors into the opening at the end of the outer jacket, the base disposed outside of the outer jacket, the stalk defining a bulb along a length of the stalk, the bulb having a larger diameter than a narrow segment of the stalk adjacent to the respective at least one bulb, wherein the stalk of the strain relief insert aligns with the clamping region of the cable, the conductors configured to engage the stalk of the strain relief insert and at least partially deform around the bulb when the cable is compressed by the clamp.

13. The cable sub-assembly of claim 12, wherein the stalk extends from a rear end at the base to an opposite front end, the bulb defining a front bulb at least one of at or proximate to the front end, the stalk further including a medial bulb between the front bulb and the base.

14. The cable sub-assembly of claim 12, wherein the stalk extends from a rear end at the base to an opposite front end, the front end of the stalk having a tapered lead-in configured to guide the stalk into the outer jacket between the conductors as the strain relief insert is loaded into the outer jacket.

15. The cable sub-assembly of claim 12, wherein the bulb along the stalk includes at least one annular rib protruding from a surface of the bulb and extending around a perimeter of the bulb.

16. The cable sub-assembly of claim 12, wherein the base includes a first side and a second side, the stalk extending from the first side, the second side defining a pressing surface for pressing the strain relief insert into the cable.

17. The cable sub-assembly of claim 12, wherein the base includes a first side and a second side, the stalk extending from the first side at an approximate radial center location of the base, the first side sloping towards the radial center location from an outer edge of the base such that a thickness of the base defined between the first and second sides is greater at the radial center location than at the outer edge.

18. The cable sub-assembly of claim 12, wherein the base defines multiple indentations extending radially inward from a perimeter of the base, the indentations being spaced apart from one another around the perimeter by intervening tabs, the base configured to receive the conductors of the cable in the indentations between the tabs, the tabs separating the conductors.

19. The cable sub-assembly of claim 12, wherein the conductors along the clamping region of the cable are positioned radially outward of the stalk of the strain relief insert between the stalk and the outer jacket, the conductors at least partially deforming around the bulb in response to the cable being compressed by the clamp such that material of the conductors flows axially away from the bulb towards the adjacent narrow segment of the stalk.

20. The cable sub-assembly of claim 12, wherein the strain relief insert is composed of a dielectric material.

* * * * *